US007674116B2

(12) United States Patent
Chen et al.

(10) Patent No.: US 7,674,116 B2
(45) Date of Patent: Mar. 9, 2010

(54) CABLE CONNECTOR

(75) Inventors: Wu-Kuang Chen, Taipei Hsien (TW); Hsiaw-Chiang Chen, Taipei Hsien (TW); Min-Qiang Zhang, Shenzhen (CN); Chang-Hua Liao, Shenzhen (CN); Guo-Zhong Liu, Shenzhen (CN); Yong-Liang Chen, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/251,399

(22) Filed: Oct. 14, 2008

(65) Prior Publication Data

US 2009/0305531 A1 Dec. 10, 2009

(30) Foreign Application Priority Data

Jun. 4, 2008 (CN) ..... 2008 1 0301999

(51) Int. Cl.
*H01R 12/00* (2006.01)

(52) U.S. Cl. ..... 439/76.1

(58) Field of Classification Search ..... 439/76.1, 439/581, 63, 701, 578
See application file for complete search history.

(56) References Cited

U.S. PATENT DOCUMENTS 3,030,451 A * 4/1962 Jacobson ..... 335/152
3,271,726 A * 9/1966 Pfendler ..... 439/76.1
4,105,278 A * 8/1978 Braund et al. ..... 439/460
4,493,525 A * 1/1985 Hall et al. ..... 439/607.47
4,720,267 A * 1/1988 De Jong ..... 439/76.1
4,786,257 A * 11/1988 Tengler ..... 439/76.1
4,871,318 A * 10/1989 Gobets et al. ..... 439/76.1
4,889,497 A * 12/1989 Riches ..... 439/76.1
5,007,863 A * 4/1991 Xuan ..... 439/639
5,209,669 A * 5/1993 Fuchs ..... 439/59
5,441,424 A * 8/1995 Morlion et al. ..... 439/581
6,390,825 B1 * 5/2002 Handley et al. ..... 439/63
6,551,144 B2 * 4/2003 Wellmann et al. ..... 439/689
6,616,480 B2 * 9/2003 Kameyama ..... 439/587
6,663,415 B1 * 12/2003 Wu ..... 439/460
6,855,003 B1 * 2/2005 Wyant ..... 439/502
6,948,949 B1 * 9/2005 Schwartz et al. ..... 439/76.1
7,094,104 B1 * 8/2006 Burke et al. ..... 439/620.01
7,168,989 B2 * 1/2007 Faulkner ..... 439/620.22
7,281,324 B2 * 10/2007 Kent et al. ..... 29/846
7,316,575 B2 * 1/2008 Muschketat ..... 439/76.1
7,364,465 B2 * 4/2008 Wu ..... 439/607.55
7,425,138 B2 * 9/2008 Buhl et al. ..... 439/76.1
7,435,106 B2 * 10/2008 Su et al. ..... 439/76.1

(Continued)

*Primary Examiner*—T C Patel
*Assistant Examiner*—Vladimir Imas
(74) *Attorney, Agent, or Firm*—Clifford O. Chi

(57) ABSTRACT

An exemplary cable connector includes a housing, a terminal module including a first terminal and a second terminal, a printed circuit board fixed in the housing, and a cable including a first core and a second core. The terminal module is detachably assembled in a first end of the housing, and the first and second terminals are contacting the printed circuit board. The cable is fixed in a second end of the housing, and the first and the second cores of the cable are welded to the printed circuit board. The first and second terminals are electrically communicating with the first and second cores via the printed circuit board.

10 Claims, 5 Drawing Sheets

U.S. PATENT DOCUMENTS

| | | | | |
|---|---|---|---|---|
| 7,479,019 | B2 * | 1/2009 | Kent et al. | 439/76.1 |
| 2001/0023153 | A1 * | 9/2001 | Mayer et al. | 439/736 |
| 2002/0004321 | A1 * | 1/2002 | Anzai et al. | 439/76.1 |
| 2004/0038564 | A1 * | 2/2004 | Yan | 439/76.1 |
| 2005/0054221 | A1 * | 3/2005 | Mayer et al. | 439/76.1 |
| 2007/0161268 | A1 * | 7/2007 | Muschketat | 439/76.1 |

* cited by examiner

CABLE CONNECTOR

BACKGROUND

1. Technical Field

The present disclosure relates to cable connectors, and more particularly to a cable connector used in an electronic device.

2. Description of Related Art

Electronic devices, such as cell phones, notebooks, and personal digital assistants, have become widely used in recent years. Generally, these electronic devices are configured to have rechargeable batteries. A cable connector is often provided to electrically connect a power source to the electronic device so that the power source is able to recharge the battery in the electronic device.

A typical cable connector includes a housing, a terminal module, and a cable. The terminal module includes a first terminal and a second terminal. The cable includes a first core welded to the first terminal and a second core welded to the second terminal. The housing is formed on the periphery of the terminal module by injection molding.

However, because the terminal module is welded to the cable, the terminal module cannot be detached from the cable connector, thereby restricting the cable connector to a single type. Thus, the cable connector cannot be used to connect to different electronic devices by changing the terminal module. In addition, if the terminal module is detached from the housing or rotated relative to the housing, the first and second cores of the cable can become easily broken at a junction where the cable connects with the terminal, thereby damaging the cable connector.

What is needed, therefore, is a new cable connector that overcomes the above mentioned disadvantages.

SUMMARY

A cable connector includes a housing, a terminal module including a first terminal and a second terminal, a printed circuit board fixed in the housing, and a cable including a first core and a second core. The terminal module is detachably assembled in a first end of the housing, and the first and second terminals are contacting the printed circuit board. The cable is fixed in a second end of the housing, and the first and second cores of the cable are welded to the printed circuit board. The first and second terminals are electrically communicating with the first and second cores via the printed circuit board.

Other advantages and novel features will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of the present cable connector. Moreover, in the drawings, like reference numerals designate corresponding parts throughout the several views.

DETAILED DESCRIPTION OF THE EMBODIMENTS

Figure 1:
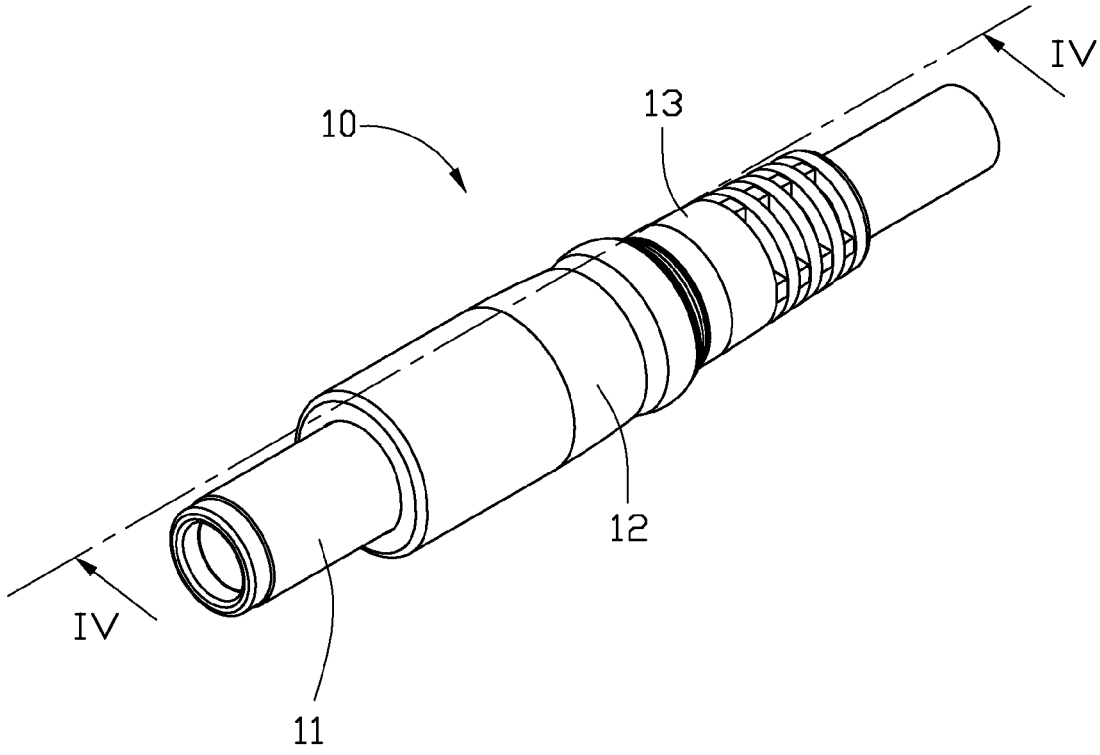
FIG. 1 is an isometric view of a first embodiment of a cable connector, the cable connector including a terminal module, a housing, a cable, and a printed circuit board.
Figure 2:
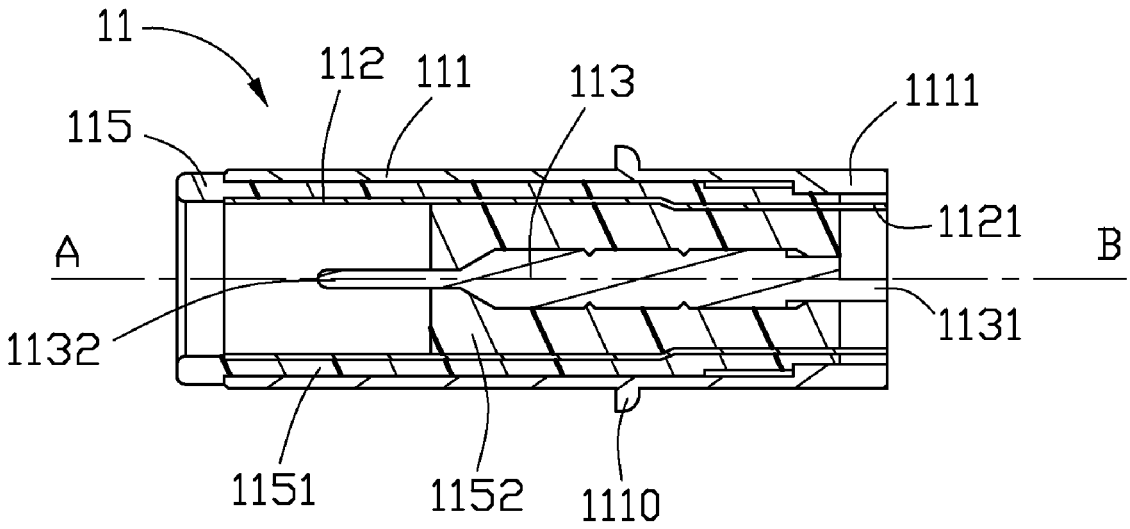
FIG. 2 is a cross-sectional view of a terminal module of the cable connector in FIG. 1.
Figure 3:
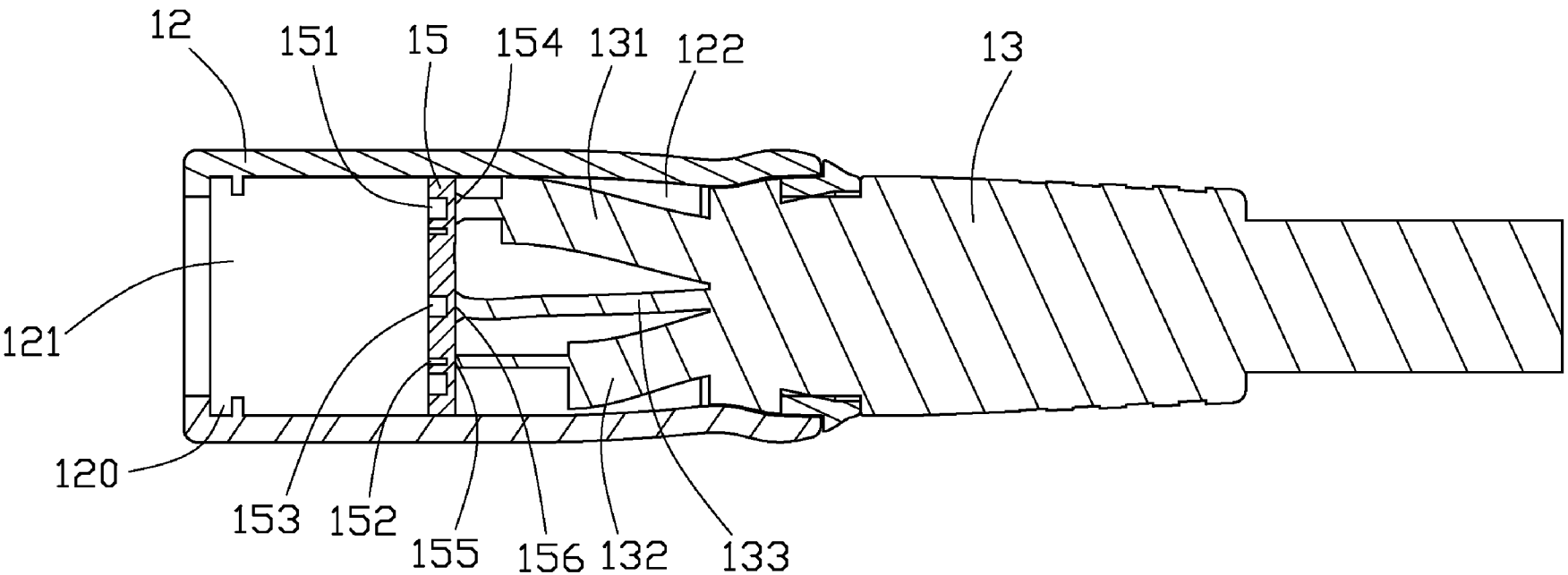
FIG. 3 is a cross-sectional view of a housing and a cable of the cable connector in FIG. 1.

Referring to FIGS. 1 through 3, a cable connector 10 includes a terminal module 11, a housing 12, a cable 13, and a printed circuit board 15.

The terminal module 11 includes a first terminal 111, a second terminal 112, a third terminal 113, and an insulator 115 configured for insulating the first, the second and the third terminals 111, 112, 113 from one another.

The first terminal 111 is substantially cylindrical shaped. A first contacting portion 1111 is formed at an end of the first terminal 111. A latching ring 1110 is formed on an outer surface of the first terminal 111. The latching ring 1110 has a rounded edge adjacent to the first contacting portion 1111.

The second terminal 112 is substantially cylindrical shaped. An end of the second terminal 112 forms a second contacting portion 1121. An outer diameter of the second terminal 112 is smaller than an inner diameter of the first terminal 111. The second terminal 112 is positioned in the first terminal 111 such that the second terminal 112 and the first terminal 111 have substantially the same central axis AB, and the second contacting portion 1121 is adjacent to the first contacting portion 1111.

The third terminal 113 is substantially cylindrical shaped. A first end of the third terminal 113 forms a third contacting portion 1131 and a second end of the third terminal 113 forms a metal pin 1132. An outer diameter of the third terminal 113 is smaller than an inner diameter of the second terminal 112. The third terminal 113 is positioned in the second terminal 112 such that the third terminal 113 and the second terminal 112 have substantially the same central axis AB, and the third contacting portion 1131 is adjacent to the second contacting portion 1121.

The first, second, and third terminals 111, 112, 113 are made of a conductive metallic material such as brass. The first, second, and third terminals 111, 112, 113 may be formed by methods such as die-casting, extrusion, forging, and punching. In addition, a metallic film such as nickel may be formed on an outer surface of the first, second, and third terminals 111, 112, 113. It may be appreciated that the first and second terminals 111, 112, may be other shapes, such as cuboidal, barrel shaped, or tubular.

The insulator 115 includes a first insulating portion 1151 positioned between the first terminal 111 and the second terminal 112 and a second insulating portion 1152 positioned between the second terminal 112 and the third terminal 113. As a result, the first, the second, and the third terminals 111, 112, 113 are electrically insulated from each other. The first, second, and third contacting portions 1111, 1121, 1131, and the metal pin 1132 are all exposed out of the insulator 115. A material of the insulator 115 may be a polymer such as polyacetal resin (POM).

The housing 12 is substantially cylindrical shaped. An inner surface of the housing 12 defines a latching groove 120 corresponding to the latching ring 1110 of the terminal module 11. It may be appreciated that the housing 12 may be other shapes, such as cuboidal, barrel shaped, or tubular.

The printed circuit board 15 is positioned in the housing 12 thereby dividing the housing 12 into a first chamber 121 and a second chamber 122. The terminal module 11 is received in the first chamber 121. The cable 13 is fixed in the second chamber 122. The printed circuit board 15 defines a first groove 151, a second groove 152 and a third groove 153 in a surface of the printed circuit board 15 facing the first chamber 121. The first groove 151, the second groove 152, and the third groove 153 are configured to receive the first, the second and the third contacting portions 1111, 1121, 1131 of the terminal module 11, respectively. The first and second grooves 151, 152 are substantially ring-shaped. The third groove 153 is substantially cylindrical. A first welding portion 154, a second welding portion 155, and a third welding portion 156 respectively corresponding to the first, the second, and the third grooves 151, 152, 153 are formed on another surface of the printed circuit board 15 facing the second chamber 122.

The cable 13 includes a first core 131, a second core 132, and a third core 133. The first core 131, the second core 132, and the third core 133 are welded to the first, second, and third welding portions 154, 155, 156, respectively.

Figure 4:
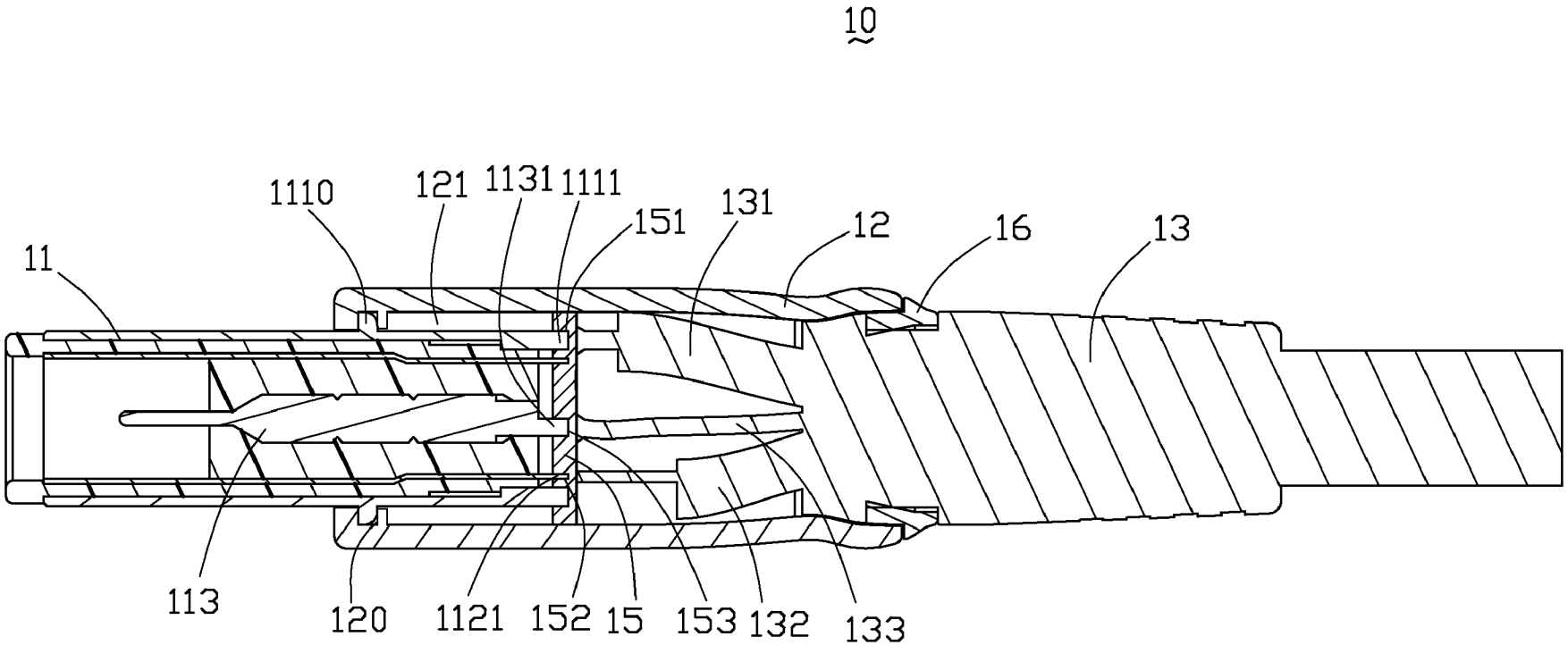
FIG. 4 is a cross-sectional view of the cable connector in FIG. 1, taken along line IV-IV.

Referring to FIG. 4, in assembly of the cable connector 10, an external force is applied to push the terminal module 11 into the first cavity 121. The latching ring 1110 of the terminal module 11 is latched with the latching groove 120 of the housing 12 to prevent the terminal module 11 from detaching from the housing. At the same time, the first, second, and third contacting portions 1111, 1121, 1131 are inserted into the first, second, and third grooves 151, 152, 153 of the printed circuit board 15, respectively. When the cable connector 10 is in operation, the first, second, and third contacting portions 1111, 1121, 1131 can be electrically communicating with the first, the second and the third cores 131, 132, 133 of the cable 13, respectively.

In one embodiment, the cable connector 10 further includes an indicator 16. In the illustrated embodiment, the indicator 16 is a light emitting diode positioned on a connecting portion between the housing 12 and the cable 13. The indicator 16 is electrically connected to the third terminal 113 via the third core 133. When the cable connector 10 is in operation and working normally, the third core 133 transmits a control signal to the indicator 16, and the indicator 16 emits light, to indicate that the cable connector 10 is working normally.

The cores 131, 132, 133 of the cable 13 are welded to the printed circuit board 15 and not welded to the terminal module 11. When the cable connector 10 is in operation, the contacting portions 1111, 1121, 1131 of the terminal module 11 are electrically communicating with the cores 131, 132, 133 of the cable 13 via the printed circuit board 15. Thus, the terminal module 11 is detachably assembled in the housing 12. Therefore, the cable connector 10 can be matched to different electronic devices by changing the terminal module. In addition, while the cable connector 10 is in use, if the terminal module 11 becomes detached from the housing 12, the terminal module 11 can be easily reassembled back into the housing 12.

In an alternative embodiment, the first, second, and third grooves 151, 152, 153 of the printed circuit board 15 may be omitted. In such condition, a first, a second, and a third conductive area are defined on a surface of the printed circuit board 15 respectively corresponding to the first, second, and third contacting portions 1111, 1121, 1131. The first, second, and third conductive areas are electrically connected to the first, second, and third cores 131, 132, 133, respectively. Thus, when the terminal module is assembled in the housing, the first, second, and third contacting portions 1111, 1121, 1131 can be electrically communicating with the first, second, and third cores 131, 132, 133 of the cable 13, respectively, via contacting the printed circuit board 15.

In another embodiment, the second cavity 122 of the housing 12 can be filled with a plastic filling. The filling plastic can fix the first, the second, and the third cores 131, 132, 133 on the housing to further protect the welding portion and the printed circuit board 15.

Figure 5:
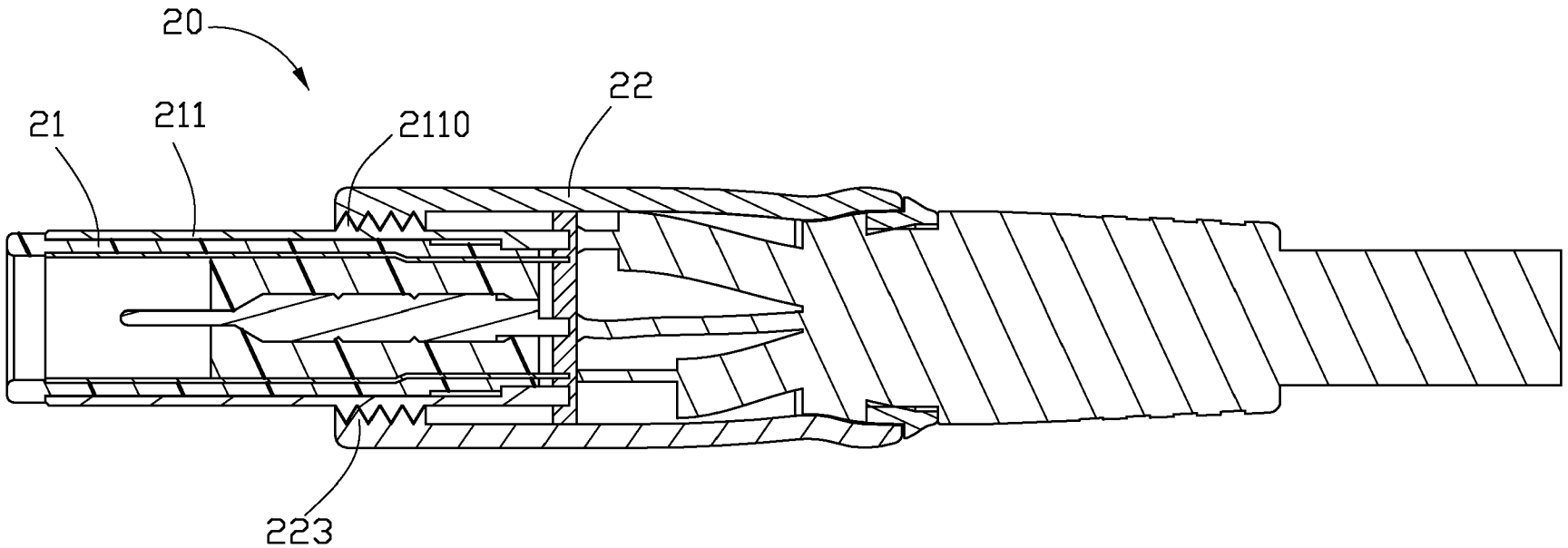
FIG. 5 is a cross-sectional view of a second embodiment of the cable connector.

Referring to FIG. 5, a second embodiment of a cable connector 20 is shown. The cable connector 20 includes a terminal module 21 and a housing 22. The cable connector 20 is similar in to the cable connector 10, except that a first terminal 211 of the terminal module 21 forms a threaded portion 2110 on an outer surface, and the housing 22 defines a plurality of threads 223 on an inner surface corresponding to the threaded portion 2110. The threaded portion 2110 is threadedly engaged with the plurality of threads 223.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A cable connector comprising:

a housing;

a terminal module comprising a first terminal and a second terminal positioned in the first terminal, the first and the second terminals being substantially cylindrical and having the same central axis;

a printed circuit board fixed in the housing; and a cable comprising a first core and a second core;

wherein the terminal module is detachably assembled in a first end of the housing, and the first and the second terminals are contacting the printed circuit board; the cable is fixed in a second end of the housing, and the first and the second cores of the cable are welded to the printed circuit board corresponding to the first and the second terminals; the first and the second terminals are electrically communicating with the first and the second cores via the printed circuit board.

2. The cable connector of claim 1, wherein the cable connector further comprises a third terminal positioned in the second terminal; the third terminal is substantially cylindrical and has a central axis collinear with the central axis of the first and the second terminals.

3. The cable connector of claim 2, wherein the first terminal comprises a first contacting portion, the second terminal comprises a second contacting portion, and the third terminal comprises a third contacting portion; the first, second, and third contacting portions are positioned adjacent to each other and contacting the printed circuit board.

4. The cable connector of claim 3, wherein the cable connector further comprises an insulator comprising a first insulating portion positioned between the first terminal and the second terminal and a second insulating portion positioned between the second terminal and the third terminal; the first, second, and third contacting portions are exposed out of the insulator.

5. The cable connector of claim 3, wherein a first groove corresponding to the first contacting portion, a second groove corresponding to the second contacting portion, and a third groove corresponding to the third contacting portion, are defined in a first surface of the printed circuit board; the first and second grooves are substantially ring-shaped and the third groove is substantially cylindrical; the printed circuit board further comprises a first welding portion corresponding to the first groove, a second welding portion corresponding to the second groove, and a third welding portion corresponding to the third groove, are formed on a second surface of the printed circuit board.

6. The cable connector of claim 5, wherein the cable further comprises a third core; the first core is welded to the first welding portion, the second core is welded to the second welding portion, and the third core is welded to the third welding portion.

7. The cable connector of claim 6, wherein the first contacting portion is inserted into the first groove so that the first terminal is electrically communicating with the first core, the second contacting portion is inserted into the second groove so that the second terminal is electrically communicating with the second core, and the third contacting portion is inserted into the third groove; so that the third terminal is electrically communicating with the third core.

8. The cable connector of claim 1, wherein the first terminal comprises a latching ring formed on an outer surface thereof; the housing defines a latching groove in an inner surface corresponding to the latching ring; the latching ring of the first terminal is latched in the latching groove of the housing.

9. The cable connector of claim 1, wherein the first terminal comprises a threaded portion formed on an outer surface thereof; the housing comprises a plurality of threads formed on an inner surface corresponding to the threaded portion of the first terminal; the threaded portion of the first terminal is threadedly engaged with the plurality of threads of the housing.

10. The cable connector of claim 1, wherein a nickel metal layer is formed on an outer surface of the first and the second terminal; the insulator is made of polyacetal resin.

* * * * *